US007721389B2

(12) United States Patent
Wildman

(10) Patent No.: US 7,721,389 B2
(45) Date of Patent: May 25, 2010

(54) INTERNAL HINGE FOR FIRE-RESISTANT SAFE

(75) Inventor: Kelvin H. Wildman, Honeoye Falls, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 507 days.

(21) Appl. No.: 10/576,352

(22) PCT Filed: Oct. 15, 2004

(86) PCT No.: PCT/US2004/034237

§ 371 (c)(1),
(2), (4) Date: Feb. 28, 2007

(87) PCT Pub. No.: WO2005/038181

PCT Pub. Date: Apr. 28, 2005

(65) Prior Publication Data

US 2007/0186385 A1 Aug. 16, 2007

Related U.S. Application Data

(60) Provisional application No. 60/512,338, filed on Oct. 17, 2003.

(51) Int. Cl.
*E05D 5/02* (2006.01)

(52) U.S. Cl. ..... 16/387; 16/389; 16/379; 16/390; 109/74; 312/409; 312/138.1

(58) Field of Classification Search ..... 16/387, 16/389, 254, 262, 390, 379; 49/383, 398; 312/139.1, 326, 329, 109, 138.1, 100, 409; 109/59 R, 64, 70, 71, 73, 74, 75, 84
See application file for complete search history.

(56) References Cited

U.S. PATENT DOCUMENTS 1,048,038 A * 12/1912 Cerny ..... 49/398
1,835,331 A * 12/1931 Pickup ..... 126/190

(Continued)

OTHER PUBLICATIONS

Lindner, Nora, "International Preliminary Report on Patentability," for International Application No. PCT/US2004/034237, Issued on Oct. 30, 2007, Geneva Switzerland.

(Continued)

*Primary Examiner*—Chuck Y. Mah
(74) *Attorney, Agent, or Firm*—Woods Oviatt Gilman LLP

(57) ABSTRACT

An internal hinge (34) for a fire-resistant enclosure is provided. The internal hinge includes a cabinet end (36) and a door end (38). The cabinet end is pivotally coupled with a bracket (64) mounted on the enclosure and the door end is fixedly coupled with a door (32) of the enclosure. The hinge includes first, second, third, and fourth segments (72, 74, 76, 78). The first segment extends linearly from the cabinet end of the hinge. The second segment extends from the first segment in a generally curved path wrapping around the cabinet end approximately 90 degrees. The third segment extends linearly from the second segment and at an angle relative to the first segment. The fourth segment extends linearly from the third segment to the door end of the hinge and is perpendicular to the first segment. The internal hinge of the present invention allows the door of the enclosure to open approximately 147 degrees.

11 Claims, 11 Drawing Sheets

U.S. PATENT DOCUMENTS

| | | | | | |
|---|---|---|---|---|---|
| 2,032,630 | A | * | 3/1936 | Northup | 296/92 |
| 2,309,001 | A | | 1/1943 | Nave et al. | |
| 2,578,610 | A | * | 12/1951 | Stone | 16/390 |
| 2,839,779 | A | * | 6/1958 | Haag | 16/375 |
| 4,704,970 | A | | 11/1987 | Sanderson et al. | |
| 4,878,267 | A | | 11/1989 | Roach et al. | |
| 5,075,928 | A | * | 12/1991 | Bobrowski | 16/273 |
| 5,282,293 | A | * | 2/1994 | Pedoeem | 16/342 |
| 5,490,306 | A | | 2/1996 | Floyd et al. | |
| 5,544,595 | A | | 8/1996 | Stephenson, III et al. | |
| 5,666,695 | A | | 9/1997 | Jegers et al. | |
| 5,722,121 | A | * | 3/1998 | Lau et al. | 16/381 |
| 5,931,104 | A | * | 8/1999 | Horn et al. | 109/59 R |
| 5,964,499 | A | * | 10/1999 | Carter | 296/186.4 |
| 5,971,515 | A | | 10/1999 | Baker et al. | |
| 6,684,457 | B2 | * | 2/2004 | Holt | 16/387 |
| 2003/0141794 | A1 | | 7/2003 | Cleveland et al. | |

OTHER PUBLICATIONS

Sandy, Robert J., "Written Opinion of the International Searching Authority," for International Application No. PCT/US2004/034237, Issued on Oct. 1, 2007, Alexandria, VA.

* cited by examiner

INTERNAL HINGE FOR FIRE-RESISTANT SAFE

CROSS-REFERENCE TO RELATED APPLICATIONS

This application claims the benefit of U.S. Provisional Application No. 60/512,338, filed Oct. 17, 2003.

STATEMENT REGARDING FEDERALLY SPONSORED RESEARCH OR DEVELOPMENT

Not applicable.

BACKGROUND OF THE INVENTION

The present invention relates to an enclosure having a cabinet and a door pivotally coupled to one another by an internal hinge. More particularly, the present invention is directed to a fire-resistant enclosure having an internal hinge. Furthermore, the present invention is directed to a water-proof enclosure having an internal hinge.

One of the purposes of a security safe is to provide a place to keep valuable objects protected from fire and disastrous acts of nature and to prevent unauthorized access to the interior compartment where the valuables are stored. Since access to the interior compartment of the safe is required by the one protecting their valuables, a door must be included in any safe. Historically, locks have been used for this purpose and are well known in the art. In particular, large and robust bolt mechanisms have been utilized to secure the safe's door when it is closed. In security safes of the size and configuration to store firearms, particularly rifles and shotguns, spring-loaded detent bolt work with manual or electronic locks and spring-loaded relockers are typically used to assure the desired protections.

The hinge for the door has always been a vulnerable attack point for gaining unauthorized access to the internal compartment of the safe since it is exposed on the outside of the safe making it easily accessible. The hinge has seen little improvement over the years as it is rather basic in it design, using a pin circularly enclosed on both a fixed side and a movable side. There have been several attempts to eliminate this attack point by eliminating the external hinge. For instance, U.S. Pat. No. 5,971,515 to Baker et al. discloses a continuous internal hinge on a safe. However, the hinge only allows the safe door to open 90 degrees, which may be inadequate for accessing the internal compartment of the safe.

Further, U.S. Pat. No. 5,666,695 to Jegers et al. discloses a leaf member having a pair of knuckles that include a retainer, which extends into the path of the pin. Annular grooves formed in the pin receive the retainer member and keep it from sliding in or out of the hinge. One of the grooves has a straight side and a tapered side, allowing the pin to slide over the second groove, but not the first groove. The structure of the safe corner is bent to form at least one knuckle and leaf member to mate with the second hinge leaf.

U.S. Pat. No. 5,544,595 to Stephenson, III et al. discloses a hinge arrangement for a gaming device that includes a hinge connecting a door to a cabinet with a gap therebetween when the door is closed. The hinge forms a pocket shaped barrier around the gap with an edge engaging a side of the pocket when pivoted 90 degrees, limiting its travel, precluding damaging adjacent gaming devices when the door is opened.

U.S. Pat. No. 5,490,306 to Floyd et al. is directed to a security cover for a barrel hinge having an inner cover plate.

U.S. Pat. No. 4,878,267 to Roach et al. is directed to a device for resisting entry of an object into a space between the hinged edge of a door and a jamb using a folded sheet of flexible material.

U.S. Pat. No. 4,704,970 to Sanderson et al. is directed to a hinge assembly of a planar-surfaced mounting bracket and a leaf member. A mounting bracket, in hex shape, is welded to the inner surface of the safe cabinet and the leaf member includes a pin that is retained by the bracket. The leaf member penetrates an open section of the frame and forms a door stop when contiguously abutting therebetween. Thus, the hinge in Sanderson limits the opening of the door to about 105 degrees relative to the door in its closed position.

Accordingly, there exists a need for an internal hinge for a fire-resistant safe that allows for sufficient opening of the door to provide adequate access to the interior compartment of the safe while eliminating an external attack point. There is a further need in the art for an internal hinge for a water-resistant safe. The present invention fills these needs as well as other needs.

SUMMARY OF THE INVENTION

In order to overcome the above stated problems and limitations there is provided an internal hinge for a fire-resistant enclosure. The enclosure includes a cabinet, a door, a false front and a bracket. The cabinet includes inner and outer walls spaced apart having insulating material positioned therebetween. The cabinet also has an access opening and a first outer edge surrounding the access opening. The door includes inner and outer walls spaced apart having insulating material positioned therebetween. The door also has a second outer edge that is adjacent to the first outer edge when the door is in a closed position. The false front is coupled with the cabinet to define an internal hinge compartment, and the bracket is coupled with the false front.

The internal hinge includes a cabinet end pivotally coupled with the bracket and a door end that is fixedly coupled with the door. Further, the hinge includes a first segment, a second segment, a third segment and a fourth segment. The first segment extends from the cabinet end of the hinge in a generally linear direction. The second segment extends from the first segment in a generally curved path wrapping around the cabinet end of the hinge approximately 90 degrees. The third segment extends from the second segment in a generally linear direction and at an angle relative to the first segment. The fourth segment extends from the third segment in a generally linear direction to the door end of the hinge and is generally perpendicular to the first segment. The configuration of the hinge of the present invention allows the door to open approximately 147 degrees relative to the closed position of the door.

The hinge of the present invention may also include a third segment that is angled approximately 20 degrees below a horizontal plane that is parallel with the first segment. The fourth segment may also extend toward a plane defined by the first segment. Furthermore, when the door is in a closed position, the first segment is generally parallel with the front surface of the door, and the fourth segment is generally perpendicular with the front surface of the door. In order to eliminate a visual or external attack point of the enclosure, the hinge may be positioned within the internal hinge compartment defined by the false front.

The enclosure may also provide for water-resistance by positioning a gasket on one of the second outer edge of the door and the first outer edge of the cabinet, and by positioning a rib on the other of the first and second outer edges. In this configuration, the gasket and the rib are positioned adjacent to one another when the door is in the closed position. Further, the first and second outer edges may define a gap when the door is in a closed position, wherein said gap is approximately 0.25 inches.

Additional objects, advantages and novel features of the present invention will be set forth in part in the description which follows, and will in part become apparent to those in the practice of the invention, when considered with the attached figures.

BRIEF DESCRIPTION OF THE SEVERAL VIEWS OF THE DRAWINGS

The accompanying drawings form a part of the this specification and are to be read in conjunction therewith, wherein like reference numerals are employed to indicate like parts in the various views, and wherein.

DETAILED DESCRIPTION OF THE INVENTION

Figure 9B:
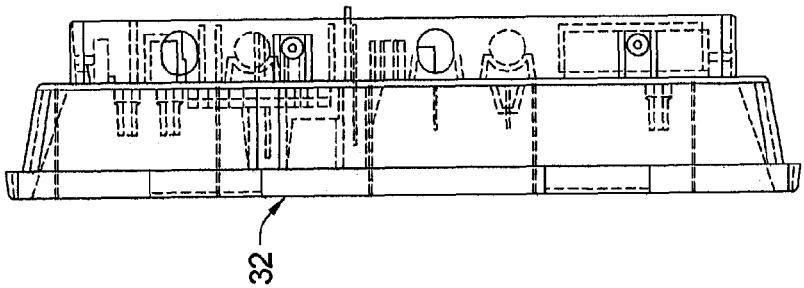
FIG. 9*b* is a side view of the door shown in FIG. 9*a;*
Figure 9A:
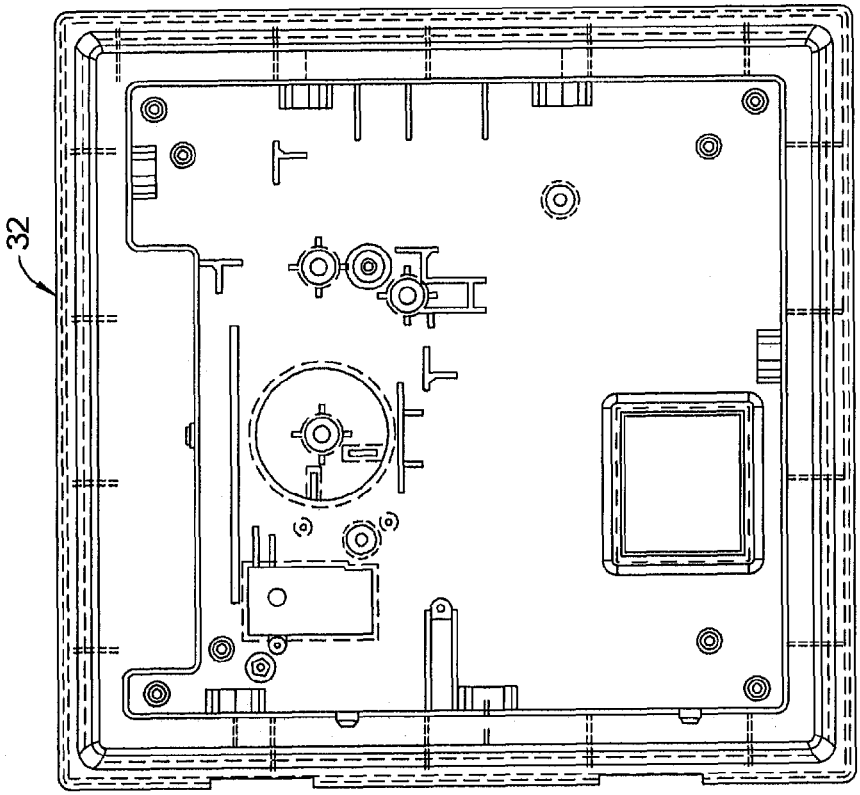
FIG. 9*a* is an rear view of the door shown in FIG. 1.
Figure 10:
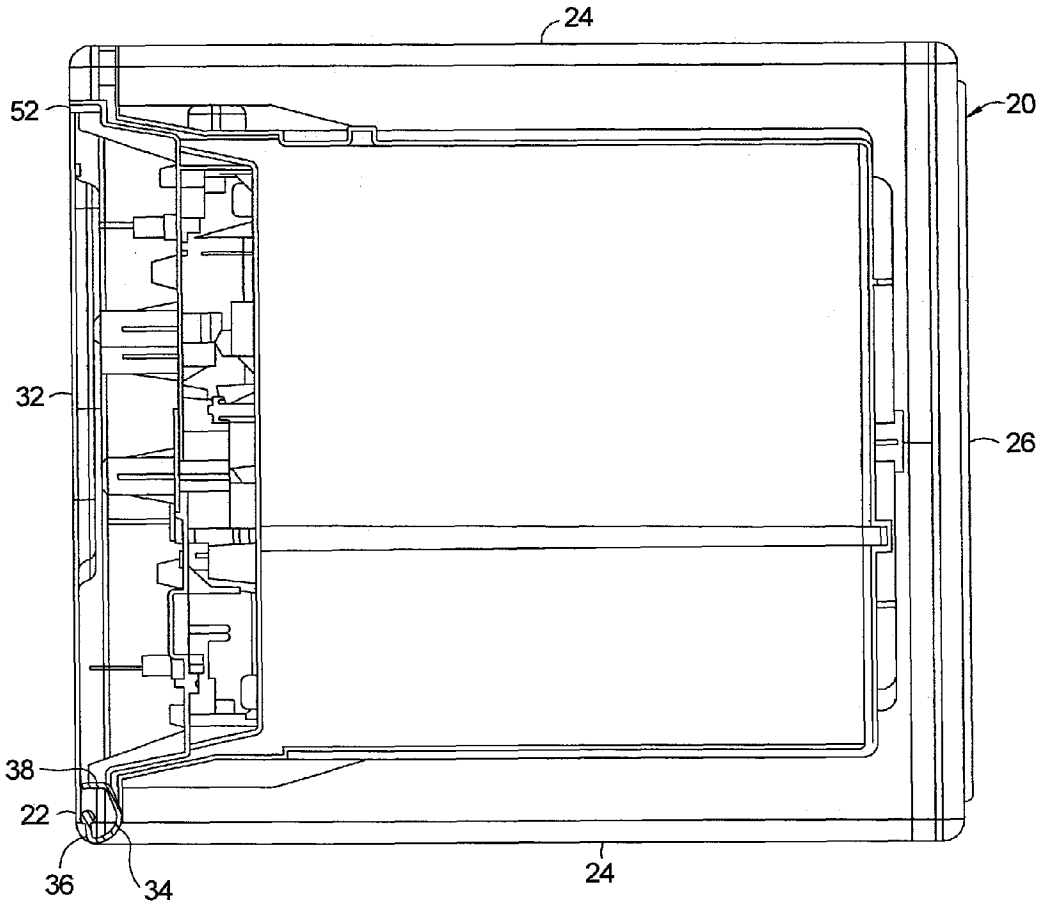
FIG. 10 is a cross-sectional side view of the enclosure shown in FIG. 1 with the door in the closed position.
Figure 11C:
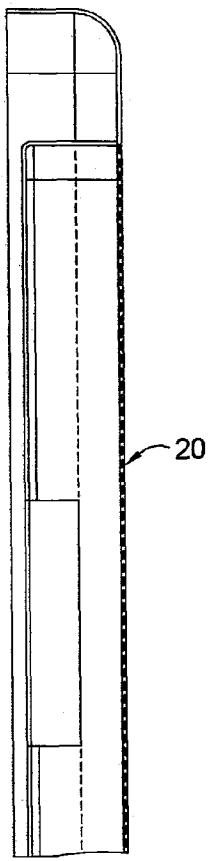
FIG. 11*c* is an enlarged view of the portion of the cabinet shown in FIG. 11*b;*
Figure 11B:
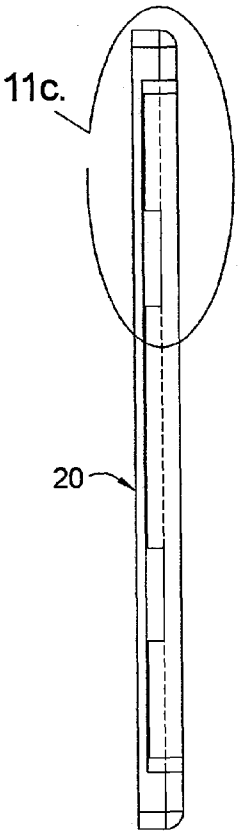
FIG. 11*b* is a cross-sectional view of a portion of the cabinet taken along line 11*b*-11*b* in FIG. 11*a;*
Figure 11A:
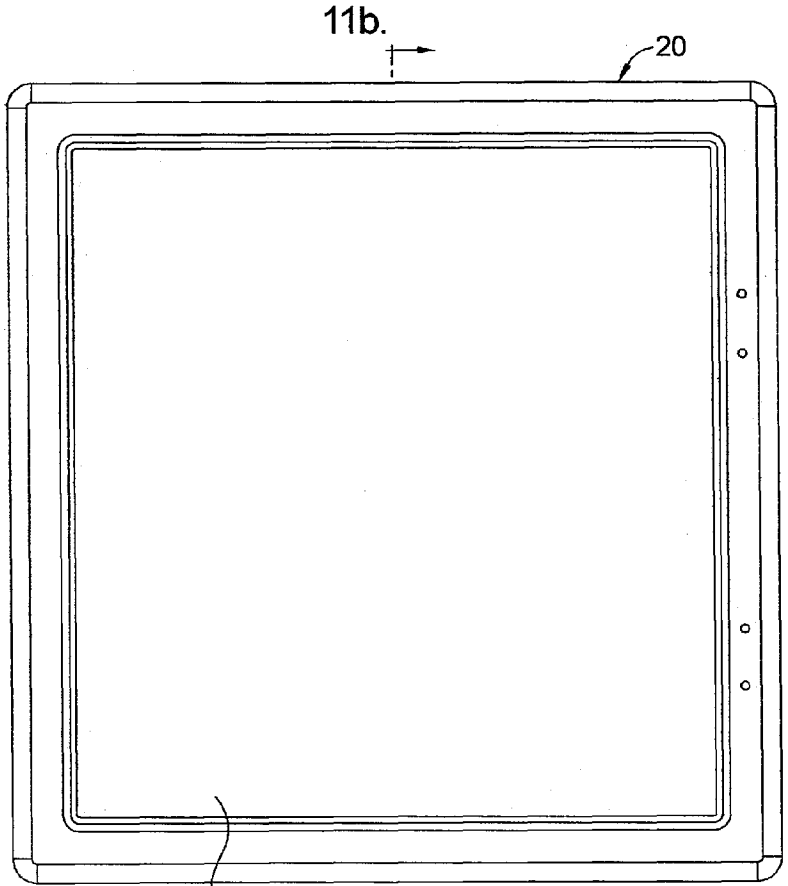
FIG. 11*a* is a front view of the cabinet shown in FIG. 1.
Figure 12A:
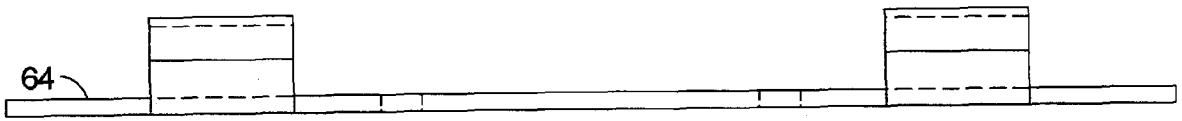
FIG. 12*a* is a front view of a bracket that is used in conjunction with the hinge shown in FIG. 1.
Figure 12B:
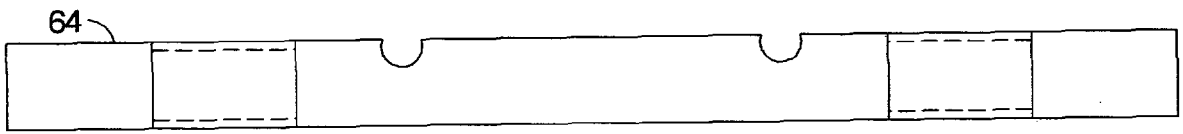
FIG. 12*b* is a top view of the bracket shown in FIG. 12*a;*
Figure 12C:
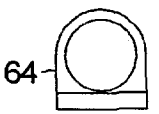
FIG. 12*c* is a side view of the bracket shown in FIG. 12*a;*
Figure 13:
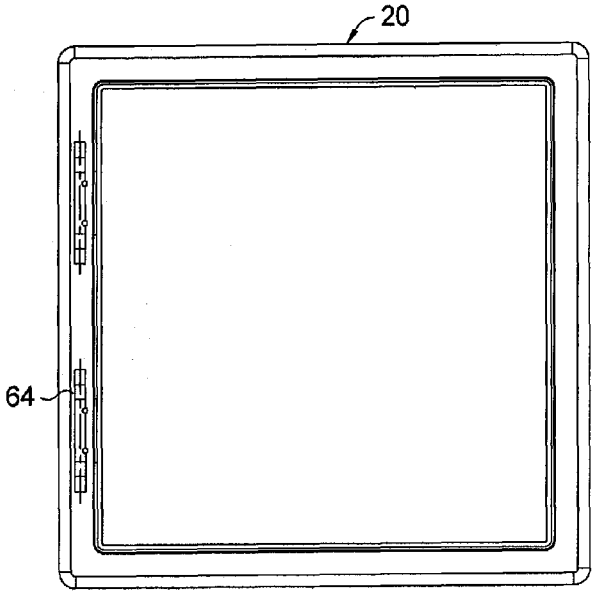
FIG. 13 is a front view of the enclosure and bracket shown in FIG. 1.

Referring now to the drawings in detail, and initially to FIGS. 1-5, reference numeral 20 generally designates a cabinet including a hinge 34 in accordance with the present invention. Cabinet 20 includes spaced apart inner and outer walls 12, 14 and a false front 22, sides 24, a back 26, and an access opening 28 in the front of cabinet 20. A door 32 is configured to fit within access opening 28 and includes spaced apart inner and outer walls 16, 18, which are adjacent to false front 22. With additional reference to FIGS. 9 and 10, inner and outer walls 12, 14, 16, 18 of cabinet 20 and door 32 define an interwall space where fire-resistant insulation material 46 may be placed to protect the safe's contents from fire damage.

Figure 1:
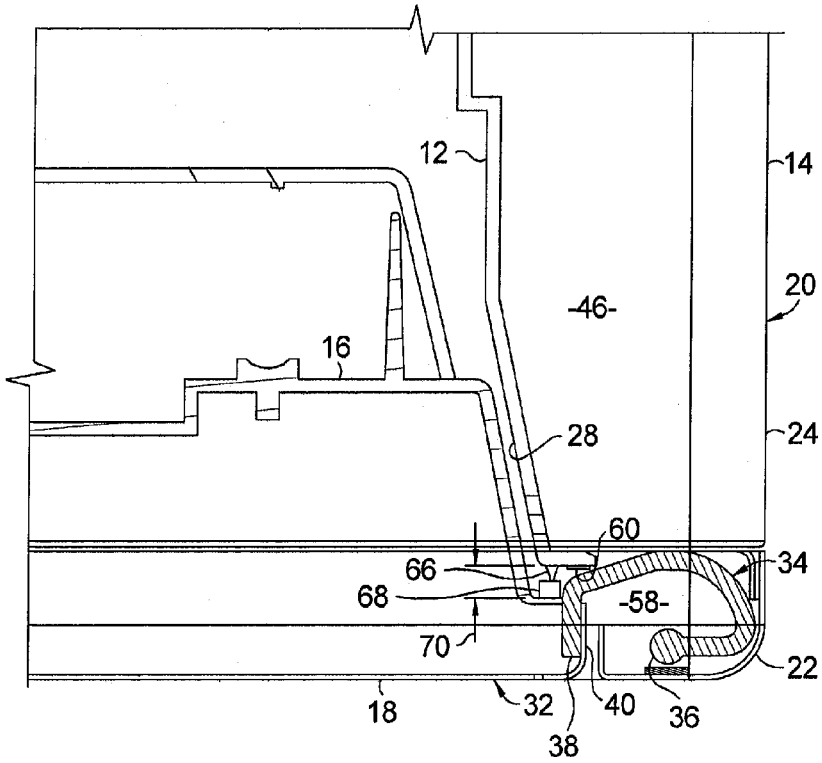
FIG. 1 is an enlarged view of an enclosure with portions broken away showing the internal hinge according to the present invention.
Figure 2:
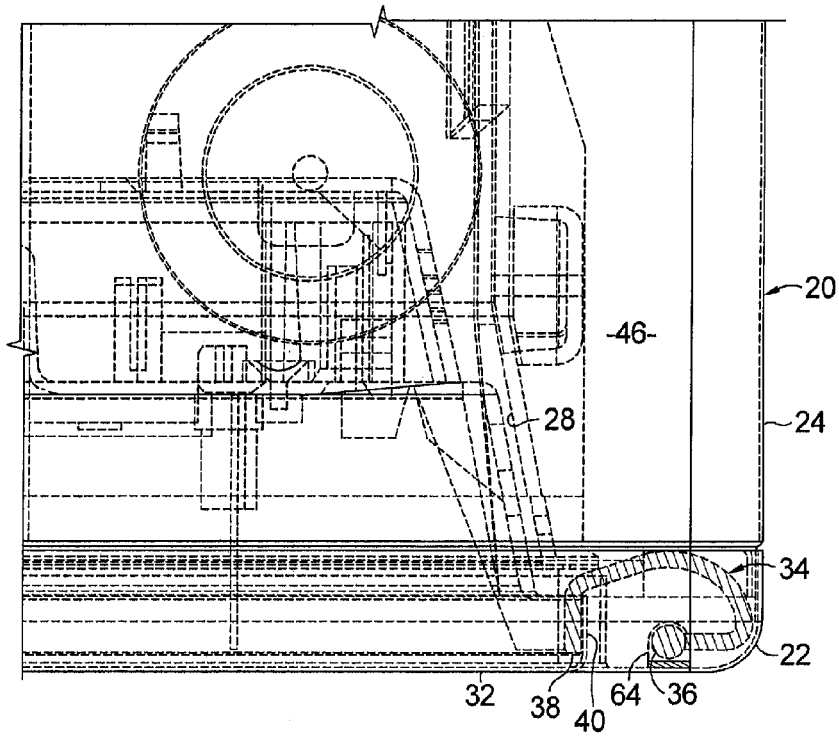
FIG. 2 is a view similar to FIG. 1 showing additional components of the enclosure in broken lines.
Figure 3:
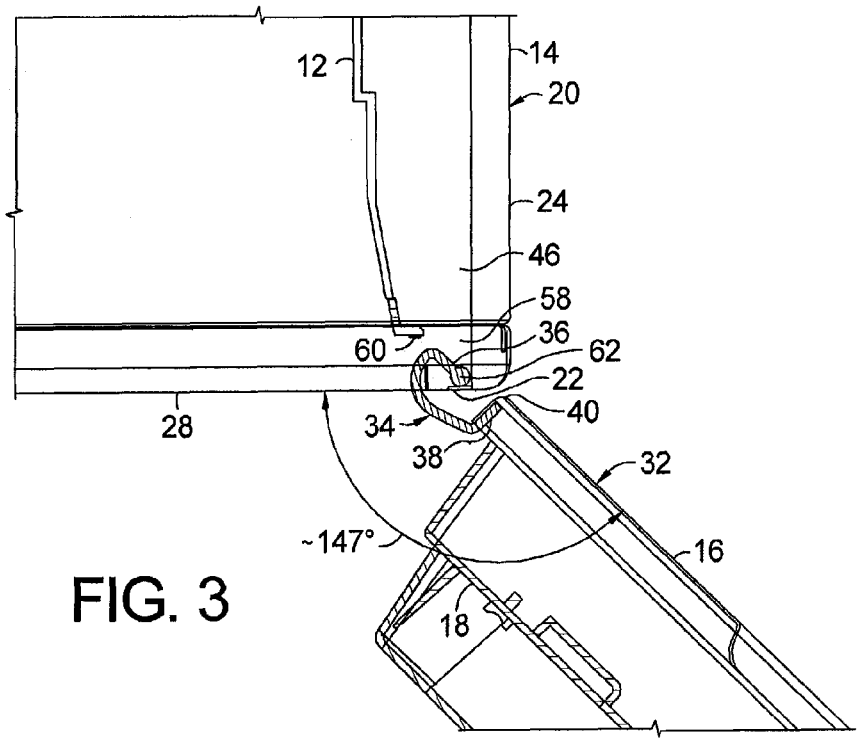
FIG. 3 is a cross-sectional view of the enclosure with portions broken away showing a door of the enclosure in an opened position.
Figure 4:
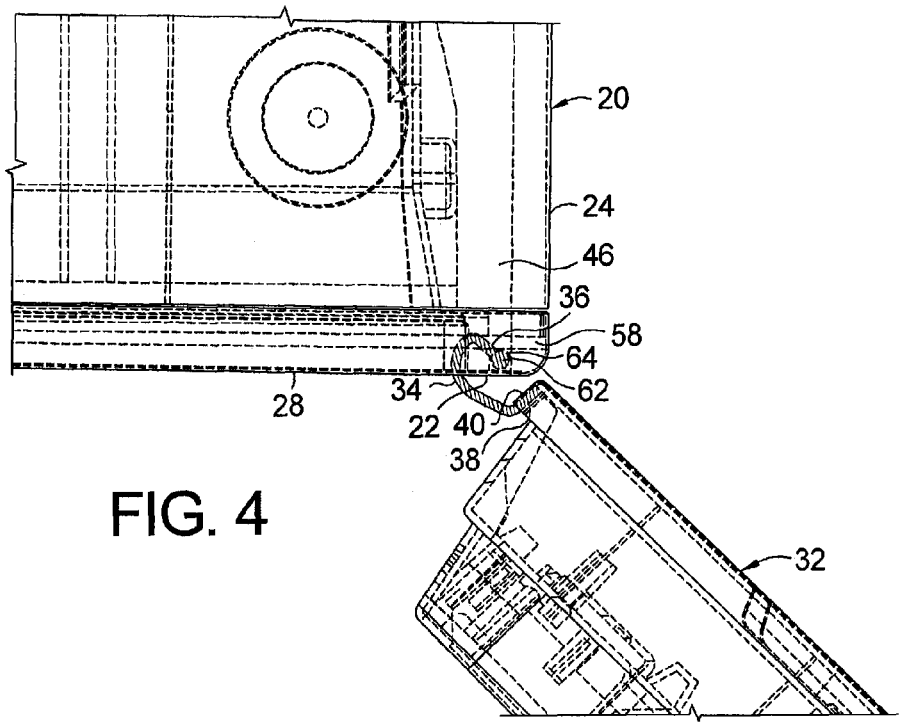
FIG. 4 is a view similar to FIG. 3 showing additional components of the enclosure in broken lines.
Figure 5:
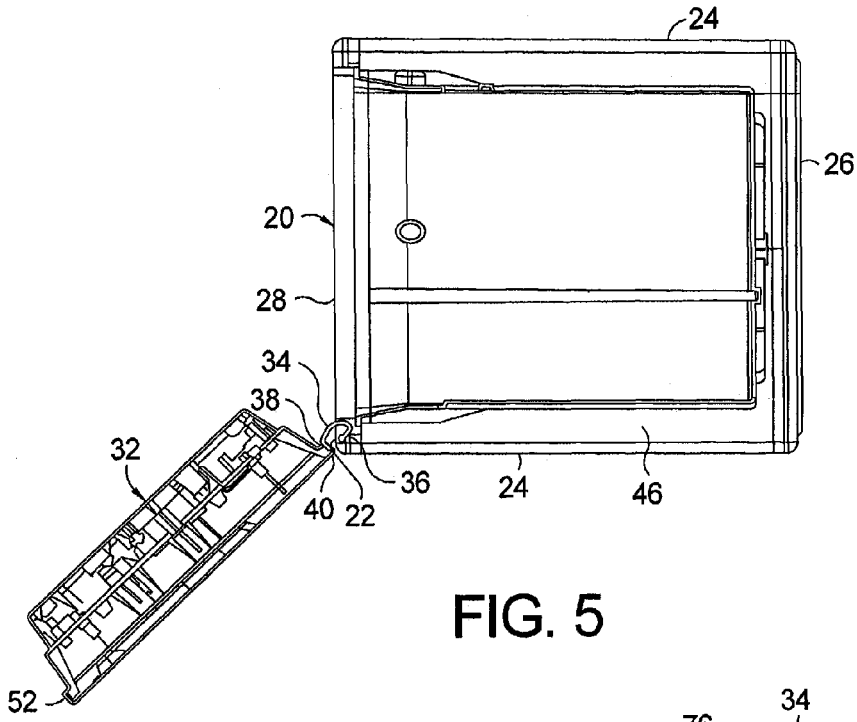
FIG. 5 is a cross-sectional view of the enclosure showing the door in the opened position.
Figure 6A:
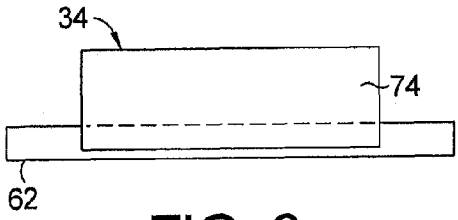
FIG. 6*a* is a view of the hinge shown in FIG. 6*b;*
Figure 6B:
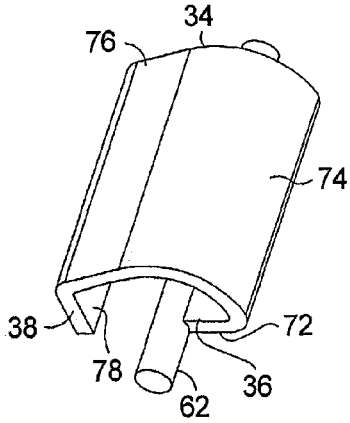
FIG. 6*b* is a perspective view of the hinge shown in FIG. 1.
Figure 6C:
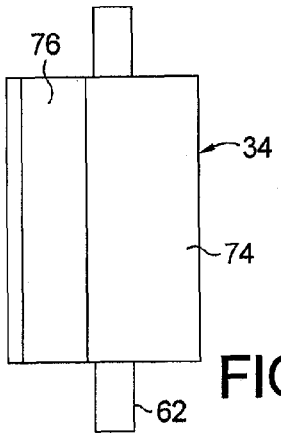
FIG. 6*c* is a side view of the hinge shown in FIG. 6*b;*
Figure 6D:
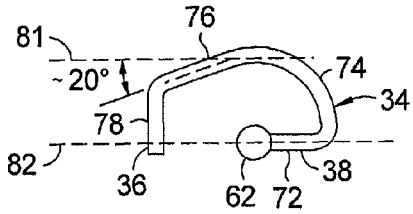
FIG. 6*d* is a top view of the hinge shown in FIG. 6*b;*
Figure 7B:
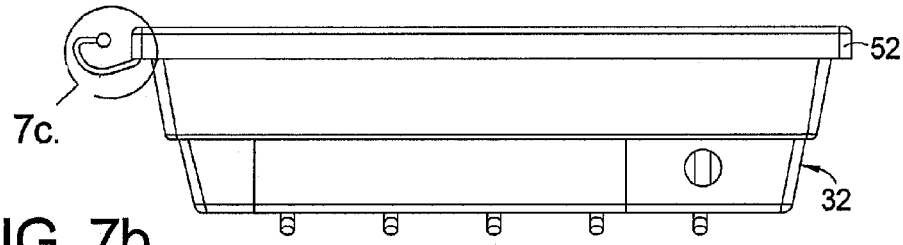
FIG. 7*b* is a top view of the door shown in FIG. 7*a;*
Figure 7A:
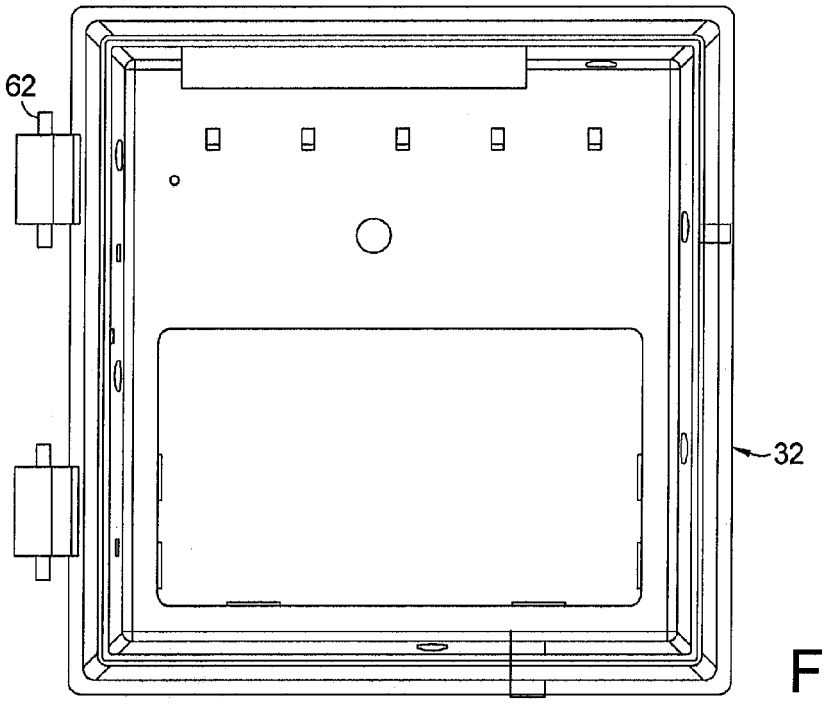
FIG. 7*a* is a rear view of the door shown in FIG. 1.
Figure 7C:
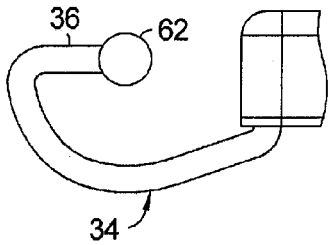
FIG. 7*c* is an enlarged view of the hinge shown in FIG. 7*b;*

With additional reference to FIGS. 6*a*-6*d*, hinge 34 generally includes a cabinet end 36 and a door end 38. Cabinet end 36 is pivotally coupled to the inside of the cabinet 20 on false front 22 within a hollow area 58. Further, door end 38 of hinge 34 is attached to door 32. Preferably, as best seen in FIG. 1, door 32 has a jamb stop 40 and door end 38 is fixably attached to jamb stop 40. With particular reference to FIG. 3, hinge 34 is configured so that the door 32 can open more that 90 degrees. In particular, hinge 34 allows door 32 to open approximately 147 degrees relative to door 32 in its closed position (FIG. 1). However, the door hinge 34 may also be configured to open at angles greater or less than 147 degrees. It will be understood and appreciated that the preferred embodiment may have one or more hinges 34 that pivotally couple door 32 to cabinet 20.

In addition to including cabinet end 36 and door end 38, hinge 34 also may include a plurality of segments that are configured to allow door 32 to open approximately 147 degrees. With reference to FIGS. 1, 3 and 6-8, it will be seen that first, second, third and fourth segments 72, 74, 76, 78 are the segments or portions that form hinge 34. Specifically, first segment 72 extends from a pin 62 in a generally linear direction. Second segment 74 extends from first segment 72 in a generally curved path wrapping around, but spaced apart from, pin 62 approximately 90 degrees. Third segment 76 extends from second segment 74 in a linear direction and may be angled approximately 20 degrees below a horizontal plane 81 that is parallel to first segment 72. Fourth segment 78 extends from third segment 76 in a linear direction that is generally perpendicular to the first segment 72 and is generally positioned on the opposite side of pin 62 relative to where first segment 72 extends from pin 62. In addition, fourth segment 78 extends toward a plane 82 defined by first segment 72. The end portion of fourth segment 78 is door end 38. When door is in the closed position as seen in FIG. 1, first segment 72 is generally parallel with the front surface of door 32 or outer wall 18, and fourth segment 78 is generally perpendicular with the front surface of door 32 or outer wall 18.

While the placement and geometry of the hinge 34 is critical for proper operation, the placement, geometry, and size of the hinge can vary depending on the geometry of the false front 22, jamb stop 40, and possibly other internal features of the cabinet such as the locking mechanism. The false front 22 protects hinge 34 from the external environment and prevents any potential intruder from easily attacking the integrity of the hinge 34. The substantially hollow area 58 between the false front 22 and the side 24 of the cabinet 20 gives the hinge sufficient clearance so that door 32 may open approximately 147 degrees.

Figure 8B:
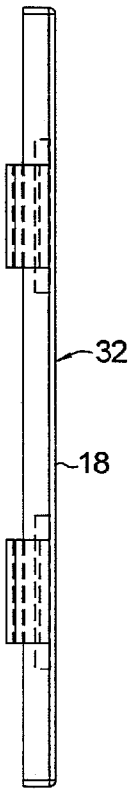
FIG. 8*b* is a cross-sectional view taken along line 8*b*-8*b* in FIG. 8*a;*
Figure 8A:
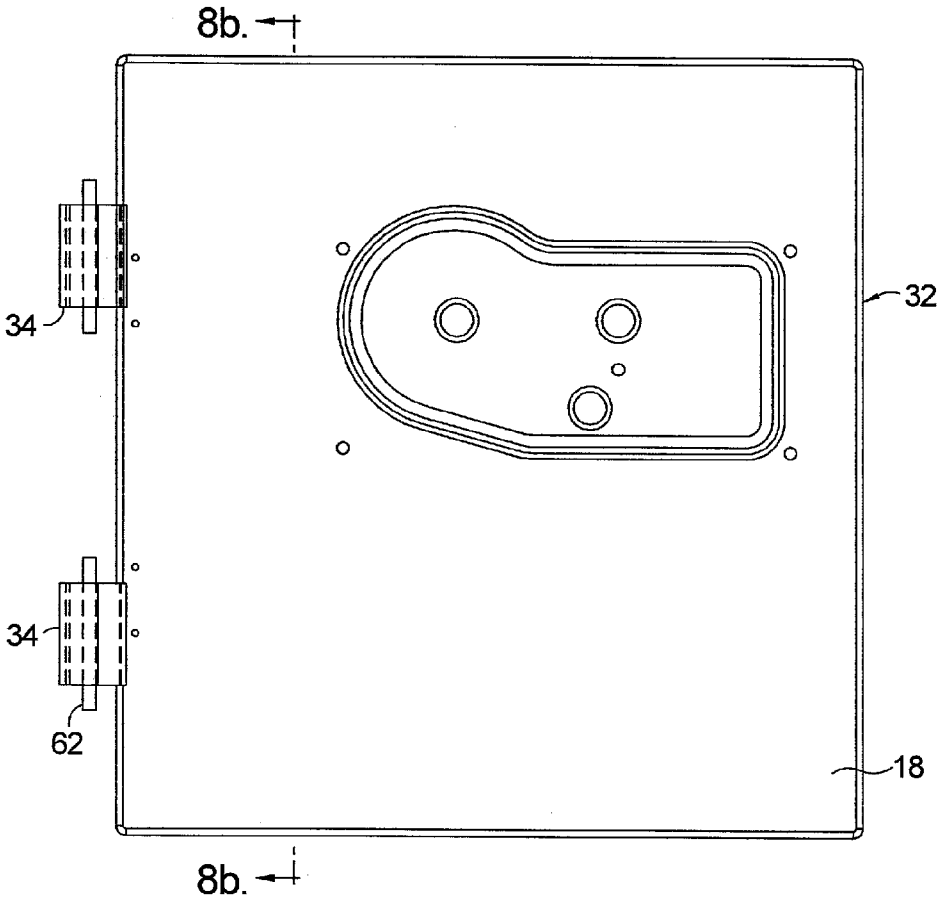
FIG. 8*a* is a side view of an outer wall portion of the door shown in FIG. 1.

The door end 38 of hinge 34 may be attached to door 32 by welding or any other means known in the art, including, but not limited to, screws, bolts, rivets and other types of fasteners. Further, as best seen in FIGS. 6 and 8, cabinet end 36 may be pivotably attached to cabinet 20 by any means known in the art, including, but not limited to, pin 62 upon which hinge 34 can pivot, enabling door 32 to open. As best seen in FIGS.

2 and 11-13, a bracket 64 may be used to attach the pin 62 to false front 22. Pin 62 may be integral with or otherwise attached to the hinge 34.

As best seen in FIGS. 1 and 3, a fastener 60 is located within hollow area 58. Fastener 60 secures a piece of metal or other substantially rigid material to the inner shell 12 of the side 24 so that the insulation 46 located between the inner and outer shells 16, 18 of the cabinet 20 does not fill the substantially hollow area 58.

Cabinet 20 is preferably formed of a single segment of flat metal sheetstock on a press brake, preferably using carbon steel, such as hot rolled steel the thickness and gauge, according to the size and desired strength of the security safe. A top and bottom are fabricated of the same material and continuously welded to the single sheet that has been formed in the front, sides and back completing cabinet 20. Cabinet 20 may be unlined or contain a fireproof lining of non-flammable insulation 46 filled between inner and outer walls 12, 14 of cabinet 20.

Figure 14B:
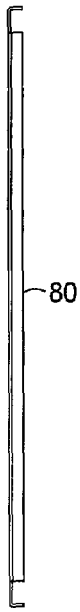
FIG. 14*b* is a side view of the retaining ring shown in FIG. 14*a*.
Figure 14A:
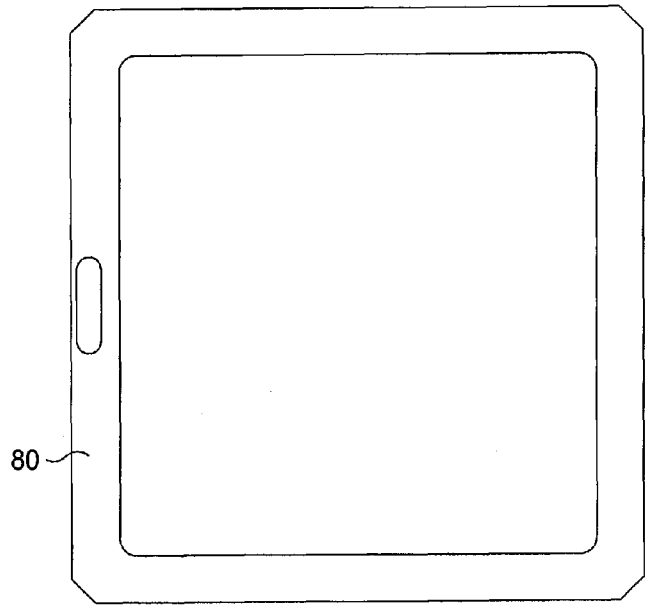
FIG. 14*a* is a front view of a retaining ring shown in FIG. 15.
Figure 15:
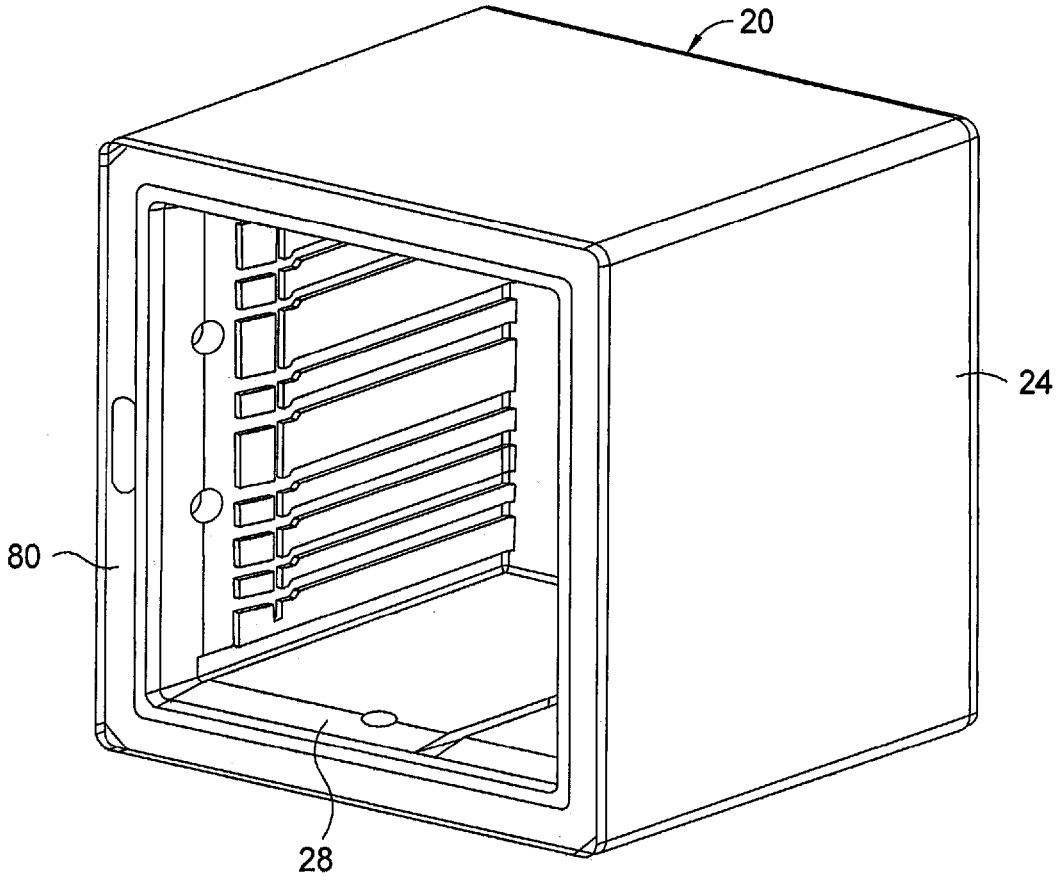
FIG. 15 is a perspective view of a blow-molded cabinet with the retaining ring shown in FIG. 14*a*.

In addition, a heat activated self-sealing gasket may be attached around the access opening 28, such as the configuration disclosed in U.S. patent application Ser. No. 10/060,721 filed on Jan. 30, 2002, entitled Fire-Resistant Gun Cabinet, which is herein incorporated by reference. It will be understood that optional interiors, such as high density fiberboard with solid oak facing and a lint free foam back material configured as shelves, rifle stalls, or a combination thereof may also be utilized with cabinet 20. As best seen in FIGS. 14 and 15, cabinet 20 may also be formed by blow molding, which would include the use of a retaining ring 80 that could be used to enclose the internal hinge.

Door 32 also may be formed from a single segment of flat metal sheetstock of similar material to the cabinet. As with cabinet 20, door 32 may be unlined or contain a fireproof lining of non-flammable insulation 46 filled between outer and inner walls 16, 18 that form door 32, along with a heat-activated self-sealing gasket attached along edge 52 of the door, as well as the jamb stop 40.

As best seen in FIG. 1, the present invention also provides for a water-resistant feature between cabinet 20 and door 32 to prevent the contents contained within cabinet 20 from being damaged. Specifically, there may be a rib 66 formed around the periphery of the front edge of cabinet 20 and a corresponding gasket 68 positioned around the edge of door 32. It will be understood that rib 66 may be positioned on door 32 and gasket 68 be positioned on the front edge of cabinet 20 to achieve the water-resistance contemplated herein. A gap 70 formed between cabinet 20 and door 32 when door 32 is closed is preferably is about 0.25 inches to provide for sufficient gasket compression when rib 66 contacts the gasket when door 32 is closed. Rib 66 and gasket 68 may be configured so that when the door is closed, the cabinet is water-resistant. Further, it will be understood that gasket 68 may be recessed within the peripheral edge of door 32.

The use of an internal hinge of the present invention to pivotally mount door 32 to cabinet 20 eliminates the need for a through-hole and any visible mounting hardware for internal components with the outside surface smooth and obstruction free. This eliminates a visible or external attack point on the safe thereby reducing the possibility that the cabinet or safe will be broken into. Furthermore, the configuration of the internal hinge of the present invention allows for the door to be opened to an angle that will allow easier access to the interior compartment of the cabinet.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. §112.

What is claimed is:

1. A fire-resistant enclosure comprising:

a cabinet having inner and outer walls spaced apart having insulating material positioned therebetween, said cabinet having an access opening and a first outer edge surrounding said access opening;

a door having inner and outer walls spaced apart and having insulating material positioned therebetween, said door having a second outer edge that is adjacent to said first outer edge when said door is in a closed position;

a false front coupled with said cabinet, said false front defining an internal hinge compartment;

a bracket coupled with said false front; and a hinge comprising:

a cabinet end pivotally coupled with the bracket;

a door end fixedly coupled with the door;

a first segment extending from said cabinet end in a generally linear direction;

a second segment extending from said first segment in a generally curved path wrapping around cabinet end approximately 90 degrees;

a third segment extending from said second segment in a generally linear direction, said third segment extending at an angle relative to said first segment; and a fourth segment extending from said third segment in a generally linear direction to said door end, said fourth segment being generally perpendicular to said first segment.

2. The enclosure in claim 1, wherein said hinge allows said door to open approximately 147 degrees relative to the closed position of the door.

3. The enclosure in claim 1, wherein said cabinet end includes a pin.

4. The enclosure in claim 1, wherein said third segment is angled approximately 20 degrees below a horizontal plane that is parallel with said first segment.

5. The enclosure in claim 1, wherein said fourth segment extends toward a plane defined by said first segment.

6. The enclosure in claim 1, wherein the door includes a jamb stop, wherein said door end is fixedly coupled with said jamb stop.

7. The enclosure in claim 1, wherein the hinge is positioned within the internal hinge compartment.

8. The enclosure in claim 1, wherein the first segment is generally parallel with the front surface of the door when the door is in the closed position.

9. The enclosure in claim 1, wherein the fourth segment is generally perpendicular with the front surface of the door when the door is in the closed position.

10. The enclosure in claim 1, further comprising:

a gasket positioned on one of the second outer edge of said door and the first outer edge of said cabinet; and a rib positioned on the other of said first and second outer edges, wherein said gasket and rib are positioned adjacent to one another when the door is in the closed position.

11. The enclosure in claim 1, wherein first and second outer edges define a gap when the door is in a closed position, wherein said gap is approximately 0.25 inches.

* * * * *